US005394952A

United States Patent [19]

Johns et al.

[11] Patent Number: 5,394,952

[45] Date of Patent: Mar. 7, 1995

[54] CORE CUTTING ROCK BIT

[75] Inventors: Roger P. Johns, Terrace Mustang, Okla.; Gary Portwood, Katy, Tex.; Gilbert S. Tyner, Mission Viejo, Calif.; Charles R. Muren, Humble, Tex.

[73] Assignee: Smith International, Inc., Houston, Tex.

[21] Appl. No.: 111,356

[22] Filed: Aug. 24, 1993

[51] Int. Cl.[6] ..... E21B 9/18

[52] U.S. Cl. ..... 175/332; 175/403

[58] Field of Search ..... 175/403, 405.1, 332

[56] References Cited

U.S. PATENT DOCUMENTS 2,901,223 8/1959 Scott .

3,134,447 5/1964 McElya et al. ..... 175/332

*Primary Examiner*—William P. Neuder

*Attorney, Agent, or Firm*—Robert G. Upton

[57] ABSTRACT

A roller cone drill bit is disclosed that leaves uncut a substantial formation core having a diameter from 10% to 25% of the bit gage diameter. The bit is designed to have normal size bearings, cone shell thickness and cutter protrusion to allow the use of standard drilling weights and RPM, thereby achieving a significant increase in drilling rate. When drilling abrasive formations, ultra hard cutting teeth are used in the cone apex to maintain the core diameter.

22 Claims, 3 Drawing Sheets

CORE CUTTING ROCK BIT

BACKGROUND OF THE INVENTION

1. Field of the Invention

The present invention relates generally to earth boring roller cone rock bits.

More particularly, this invention relates to roller cone drill bits that leave uncut a significant size core of the formation being drilled to substantially enhance the drilling rate of the bit. The diameter of the core being left is preferably maintained by the use of inserts in the cone apices made of significantly harder and more wear resistant material than are the main cutting elements on the roller cones.

2. Description of the Prior Art

Roller cone rock bits are used extensively in drilling for petroleum, minerals and geothermal energy. Roller cone bits generally comprise a main bit body which can be attached to a rotary drill string. The bit body normally includes two or three legs which extend downward. Each leg has a journal beating extending at a downward and inward angle. A roller cone with tungsten carbide inserts (TCI bit), steel teeth (milled tooth bit) or other cutter elements positioned on its outer surface, is rotatably mounted on each journal or roller bearing. During drilling, the rotation of the drill string produces rotation of each roller cone about its bearing thereby causing the cutter elements to engage and disintegrate the rock.

Because of their aggressive cutting action relatively fast drilling rates are achieved, but very often roller bits designed to drill the entire hole bottom do not drill at acceptable rates.

U.S. Pat. No. 2,901,223 describes a "milled-tooth" roller cone drill bit with large steel teeth designed to leave uncut a substantial formation core at the center of the borehole bottom when drilling very soft, deformable strata to enhance the rate of penetration. The core diameter is maintained by the steel teeth at the apex or "spear-point" of each roller cone. The core is broken up when contacting a centrally and vertically positioned core breaker extending from the bit body. The broken core fragments are flushed out from under the bit by drilling fluid exiting from jet nozzles directed between the cones. This bit design did not gain much acceptance as all of the steel teeth wore away fairly rapidly. Although the wear of the outer teeth on the cones was not severe enough to stop the drilling process, the wear of the teeth on the cone apices allowed a core of ever-increasing diameter to form. This design also lacked intermeshing teeth that decreased the bearing size and prevented self-cleaning of teeth that can lead to bit balling. Neither the mechanical action of the core breaker mechanism, nor the jet hydraulic energy were sufficient to the break and flush the enlarged core from under the cutting structure of the bit, thereby stopping the drilling process prematurely. A costly "round trip" of the drill string was then necessary to replace the worn bit.

U.S. Pat. No. 3,134,447 shows a tungsten carbide insert type roller bit for drilling fairly hard and abrasive rock formations. This bit type was deliberately designed to leave a very small uncut formation core to alleviate the undercutting of the steel at the apex of the cone with subsequent loss of the carbide inserts. By terminating the cone before it reaches the bit center, a blunter cone can be made that will accommodate many more carbide inserts, thereby protecting the steel of the cone apex from abrading away and ultimately losing inserts. This bit, while useful in drilling a very limited range of very hard and abrasive rocks, does not compete in drilling the major range of sedimentary formations because of very slow drilling rates. The slow drilling rate is directly attributable to the massive concentration of carbide inserts in the apex areas of the roller cones, which produces a very low point loading of the rock by the inserts. This low point loading is generally insufficient to reach the fracture threshold of the rock being drilled.

A new roller cutter drill bit is disclosed which overcomes the inadequacies of the prior art.

SUMMARY OF THE INVENTION

It is an object of the present invention to drill soft to medium hard earthen formations at a faster rate of penetration compared to roller cutter drill bits in present use.

More specifically, it is an object of the present invention to provide a roller cone drill bit that leaves an uncut earthen core of such size that the drilling rate of the bit is significantly increased. The diameter of the core is maintained to the original design dimension throughout the useful life of the main cutting structure teeth or carbide inserts of the bit. This is preferably accomplished by the use of one or more ultra hard core trimmer inserts on the roller cone apices that are an order of magnitude harder and more wear resistant than the teeth or inserts of the main cutting structure of the bit. The core is easily broken off at its base on the hole bottom and then broken up into rock chips by the intermediate circumferential rows of teeth or inserts on the rotating cones. The chips are then circulated from under the bit cutting structure by drilling "mud" exiting jet nozzles positioned between the roller cones.

A roller cutter drill bit is disclosed for drilling soft to medium hard earth formations. The drill bit forms a body having a first opened threaded pin end and a second cutting end. The pin end is adapted to be threadably connected to a drilling fluid or "mud" transporting drill string. The cutting end of the bit body has at least two, but preferably three legs extending downwardly. Bearing journals extend downwardly and inwardly from the legs, with frusto conical cutters rotatably mounted thereon. Teeth or carbide inserts are fixedly mounted on the cones in intermeshing circumferential rows. The foreshortened apices of the cones are each fitted with at least one insert preferably positioned off-center to each cone axis and where the insert cutting tip is off-set from the bit centerline a distance that they leave a formation core with a diameter of at least 10% of the bit gage diameter.

A rotary cone rock bit for drilling earthen formations is designed to form a core while drilling for enhanced bit penetration rates. The bit consists of a bit body forming a first threaded pin end and a second cutter end. The bit body further forms at least a pair of legs that support roller cutter cones rotatively retained on beatings cantilevered from an end of the legs. The cutter cones contain circumferential rows of individual cutters and the cones engage all but 10% to 25% of the diameter of the borehole formed in the formation leaving a central core thereby.

One or more core cutter means is formed substantially at an apex of each cone for cutting the core. The core cutter means generally and preferably consists of an ultra hard material that is harder and more wear resistant than the individual cutters in each of the circumferential rows formed on the cutter cones.

Earthen formations that are medium to hard are normally drilled with bits having tungsten carbide inserts mounted in circumferential rows on the cones and formations that are soft to very soft are normally drilled with bits having milled steel teeth on the cones. Therefore, bits with carbide inserts designed to leave an uncut core would preferably have carbide inserts coated with a diamond layer in the apices of the roller cones. Also, bits with milled steel teeth designed to leave an uncut core would generally have tungsten carbide inserts in the cone apices, although for certain weak formations, a hard material insert or spear point in the cone apex may not be necessary to cut and maintain a significant core.

An advantage then, of the present invention over the prior art, is the incorporation of a cutting mechanism that takes advantage of the great hardness and abrasion resistance of diamond and tungsten carbide to aggressively perform the role of formation core trimmers to increase the drilling rate of the drill bit. Also, the ultra hard diamond and/or carbide inserts outlast the other critical cutter components of the drill bit in which they are incorporated.

More particularly, an advantage of the present invention over the prior art is the use of diamond coated carbide inserts to aggressively cut and maintain the diameter of the core left uncut by a drill bit fitted with tungsten carbide main cutting inserts. It is also advantageous to use tungsten carbide inserts as core cutters in a drill bit fitted with milled steel teeth. In the above embodiments, the diamond or carbide core cutter inserts have the properties necessary to outlast the other components of the drill bit in which they are incorporated.

It is also an advantage of the present invention over the prior art that the teeth or inserts on the cones are intermeshed for good cleaning.

It is yet another advantage of the present invention over the prior art that the geometry of the cones allow the use of standard large bearings and long protrusion of the teeth or inserts for long life and high penetration rates.

The above-noted objects and advantages of the present invention will be more fully understood upon a study of the following description in conjunction with the detailed drawings.

DESCRIPTION OF THE PREFERRED EMBODIMENTS AND BEST MODE FOR CARRYING OUT THE INVENTION

Figure 1:
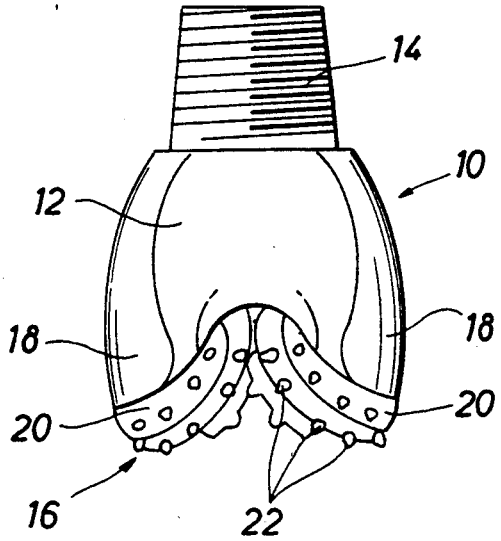
FIG. 1 is a side view of a three cone tungsten carbide insert drill bit.

With reference to the side view of FIG. 1, the drill bit generally designated as 10, consists of a bit body 12 having an open threaded pin end 14 and an opposite cutting end generally designated as 16. Three legs 18 extend downwardly and inwardly having three roller cones rotatably mounted thereon. Tungsten carbide inserts 22 are strategically affixed on cones 20. Fluid nozzles (not shown) are positioned between the cones 20 to direct drilling fluid to the bit cutting end 16 to carry the drill cuttings from the borehole bottom. The nozzles hydraulically communicates with a plenum containing a fluid source in bit body 12 (not shown).

Figure 2:
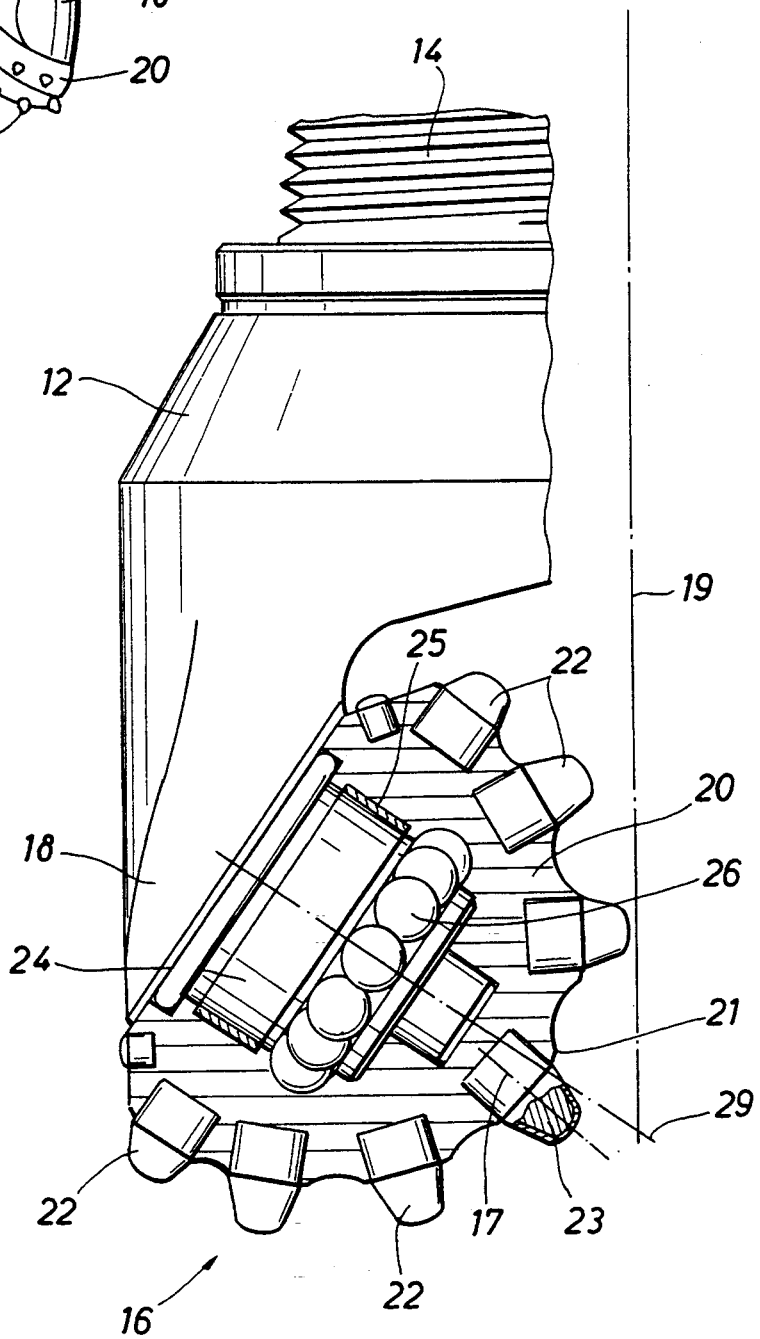
FIG. 2 is a partial cross-section of a leg and roller cone of the bit shown in FIG. 1.

The partial cross-section of FIG. 2 shows bit body 12 having leg 18 extending downward with bearing journal 24 supporting rotatably mounted cone 20, which is retained on journal 24 by ball bearings 26. Friction bearing 25 supports the down thrust load while drilling. Tungsten carbide inserts 22 are strategically affixed in circumferential rows on roller cone 20. The size, shape and number of inserts 20 are governed by the properties of the rock being drilled. A tungsten carbide insert having a polycrystalline diamond layer on the cutting end 23, for example, is affixed on the apex 21 of cone 20.

Diamond coated insert 23 is described in detail by U.S. Pat. No. 4,811,801 (see FIGS. 3, 3*a* and 4), assigned to the same assignee as the present invention. The patent is included in its entirety by reference.

Figure 3:
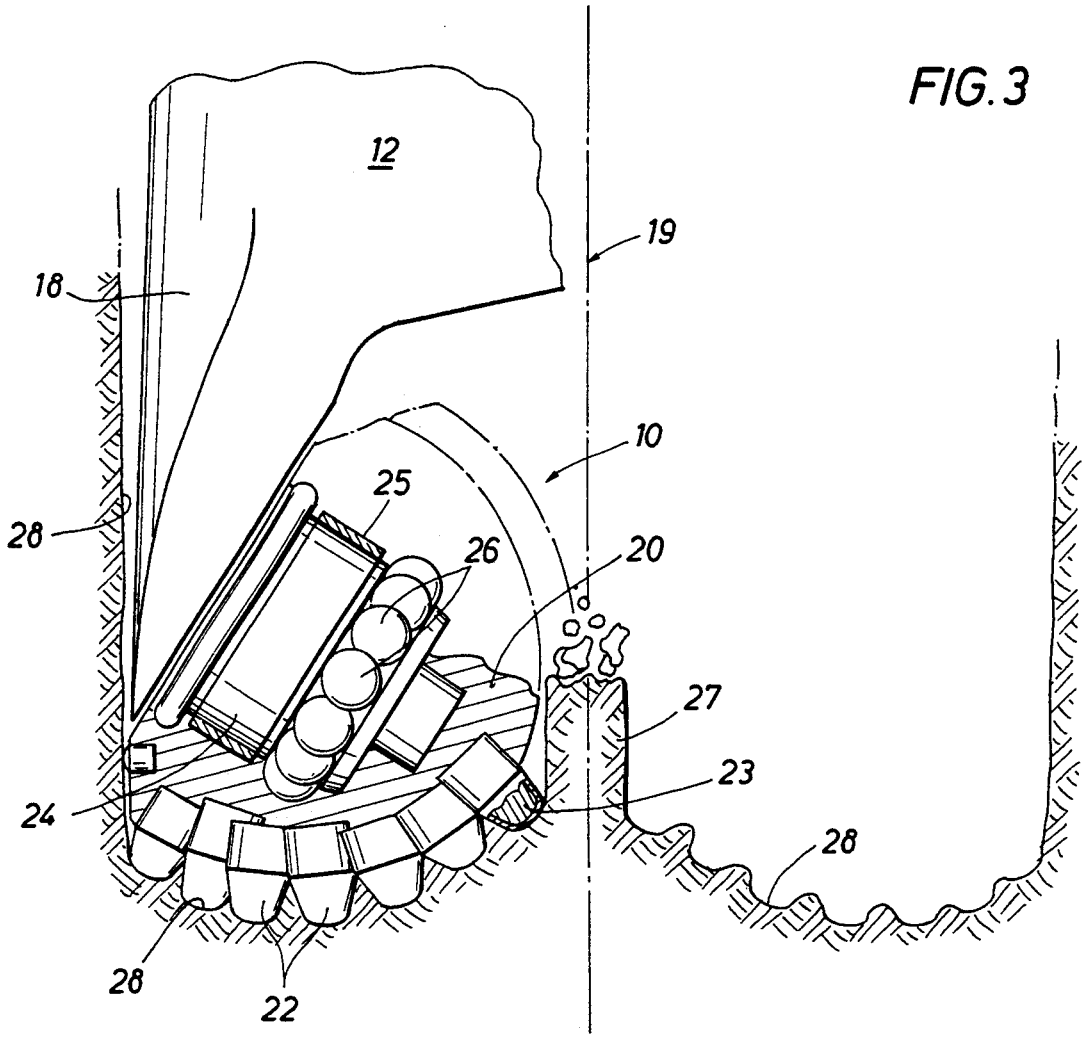
FIG. 3 is a cross-section of a borehole with a tungsten carbide drill bit leaving an uncut formation core.

Insert 23 is positioned so its axis 17 is generally not parallel with the axis 29 of cone 20 to give it a striking motion against the core 27 to induce fracture thereto (see FIG. 3). Of course, it should be understood that insert 23 may be positioned coincident with cone axis 29 and any off-set or skew (not shown) of cone 20 will impact an off-center shearing action to insert 23 thereby drilling and maintaining the diameter of core 27. It should be noted that, depending on the actual cone geometry 20 and the rock formation properties anticipated, more than one diamond coated insert 23 may be mounted in the apex 21 of cone 20 (not shown). In the apices of the other two cones (not shown) more than one diamond coated insert 23 may be used, with the exact number being dependent on the formation properties anticipated and the specific bit design.

FIG. 3 illustrates a bit 10 positioned adjacent a section of the bottom portion 28 of a borehole. The bit, in this example, is designed to drill medium to hard rock formations while simultaneously cutting a core 27 with a diamond coated insert 23. The diameter of core 27 is governed by the position of insert 23 in respect to the vertical axis of drill bit 10. It has been determined that leaving an uncut core 27, having a diameter greater than 10% of the gage diameter of bit 10, significantly increases the drilling rate and reduces the drilling cost per foot of hole drilled. The diameter of the core 27 is defined as the largest diameter of formation left uncut at the bottom of a borehole 28 by the insert 23 positioned on each apice of each of the cones, the insert being closest to the hole center line 19 at its lowest rotational position as the cone rotates on its journal 24. Although it is desirable to leave a large core 27, a core 27 greater than 25% of the bit gage diameter is extremely difficult to break up and flush from under the bit 10. This mandates that insert 23, cutting and trimming a core to size, can not wear any significant amount without the core 27 getting to an unmanageable size. Also, if insert 23 wears enough to allow the very abrasive core 27 to bear on cone 20 and ultimately to wear through the cone 20, results in failure of bearing 25 and 26. Therefore, it is very beneficial for the core trimmer insert 23 to be essentially non-wearing diamond coated, as described above, to limit the size of the generated core 27 and also to prevent the abrasive core 27 from wearing through the cone shell 20.

In a specific example, a TCI bit having a diameter or gage of $7\frac{7}{8}$ inches would preferably cut a core between 80 and 2.00 inches in diameter for optimum bit performance in an earthen formation.

Also, limiting the size of a core 27 allows the cone 20 to be of normal size and wall thickness, giving room to provide a standard bearing assembly 25 and 26 so that normal drilling parameters of drilling weight and rotary speed can be maintained in the drilling process.

When drilling certain soft, but very abrasive, earthen formations, tungsten carbide insert type roller cone drill bits, as described above, are not used because the limited extension of the cutting structure is not aggressive enough to produce an acceptable rate of penetration. Therefore, bits having long teeth milled on steel roller cones are used for this purpose. These bit types are designed to impart a large amount of drag or shear motion to the teeth which tends to wear the steel away fairly rapidly. This is especially true close to the center or apex 21 of cone 20.

Figure 4:
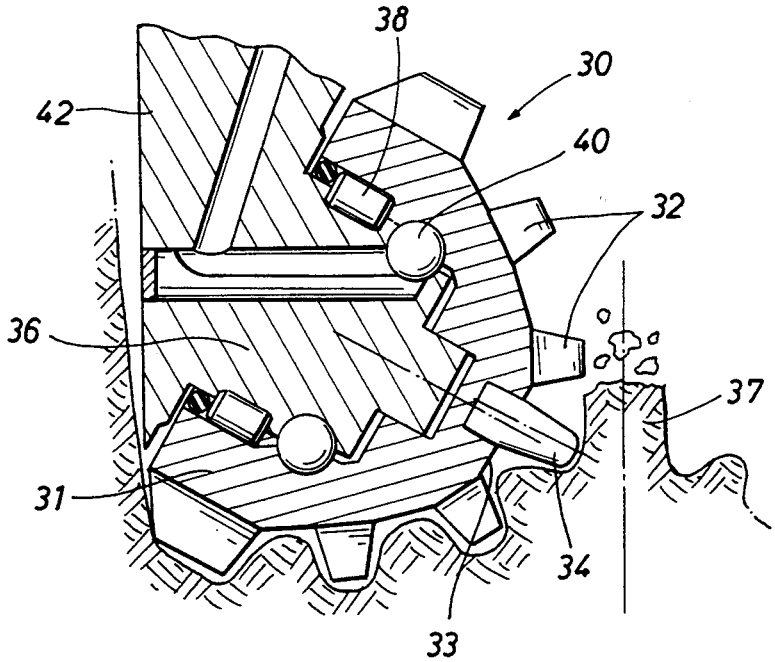
FIG. 4 is a partial cross-section of a milled steel tooth drill bit.

FIG. 4 shows the lower section of a milled teeth roller cone bit generally designated as 30. The roller cone 31 is supported on journal 36 by roller bearings 38 and ball beatings 40. Milled steel teeth 32 intermesh with teeth 32 on the other cones (not shown) to engage the entire hole bottom except the center core 37, 10%–25% which is left uncut. Nose cutter 34 is, for example, an abrasion resistant tungsten carbide insert that will last much longer than the outer steel teeth 32. With this arrangement, a significant increase in drilling rate is obtained coupled with an acceptable life expectancy to affect a very desirable reduction in drilling cost per increment of hole drilled.

In certain very abrasive rocks, a diamond coated tungsten carbide nose insert may be justified (not shown). Here again, FIG. 4 shows one tungsten carbide insert 34 in the apex 33 of cone 31. It should be noted that, dependent on the particular geometry of cone 31 and the anticipated rock formations, there could be more than one insert 34 in the apex 33. The other two cones (not shown) of the bit 30 may have inserts in their apices, the exact number being regulated on the cone geometry (not shown) and the formation properties.

Figure 5:
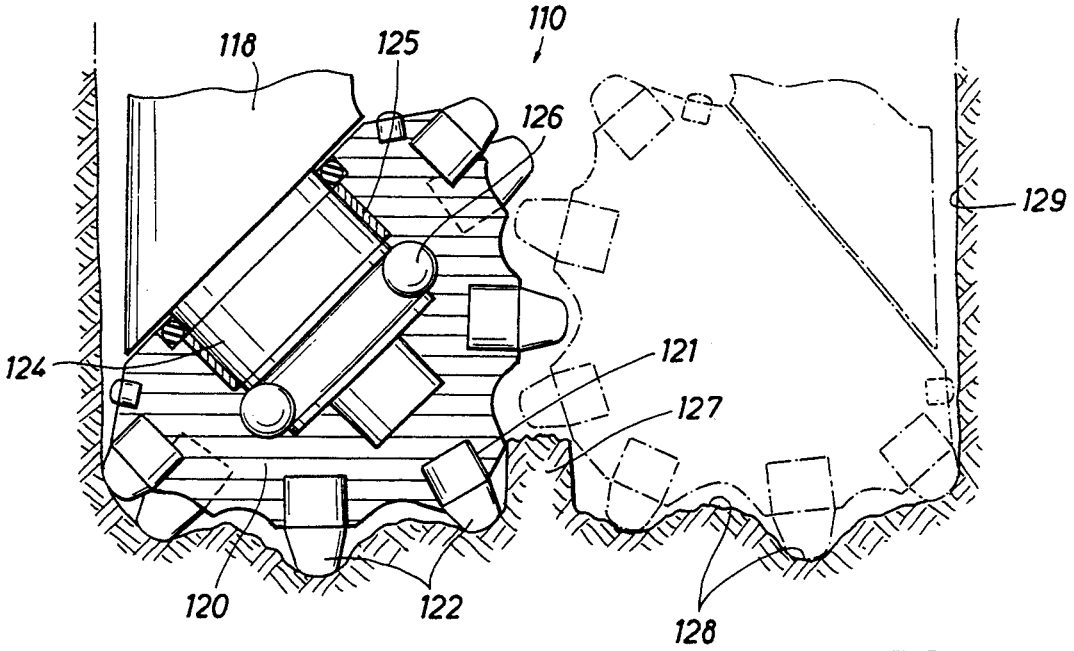
FIG. 5 is a partial cross-section of one tungsten carbide insert cone and a phantom outline of an adjacent cone depicting an uncut formation core.

FIG. 5 illustrates a bit 110 positioned on the bottom 128 of borehole 129. The example bit is designed to drill medium to soft, non-abrasive rock formations while concurrently cutting a core 127. Bit 110 is fitted with tungsten carbide cutting inserts 122. The diameter of the uncut core 127 is governed by the position of rungsten carbide insert 122 which is located in cone apex 121. Because the anticipated rock formations are not extremely hard and are non-abrasive, tungsten carbide is sufficiently hard and wear resistant to withstand the abrasive action of cutting and maintaining the desired diameter of core 127. With the inserts 122 intermeshing, the cone 120 has dimensions that allow normal friction bearing 125, ball beatings 126 and carbide insert 122 protrusion. This allows normal rotational speeds and drilling weights. Therefore, drilling rates are greatly increased when core 127 is left uncut as heretofore described and useful drilling life is at least parity to significantly lower the drilling cost per increment of hole drilled.

Figure 6:
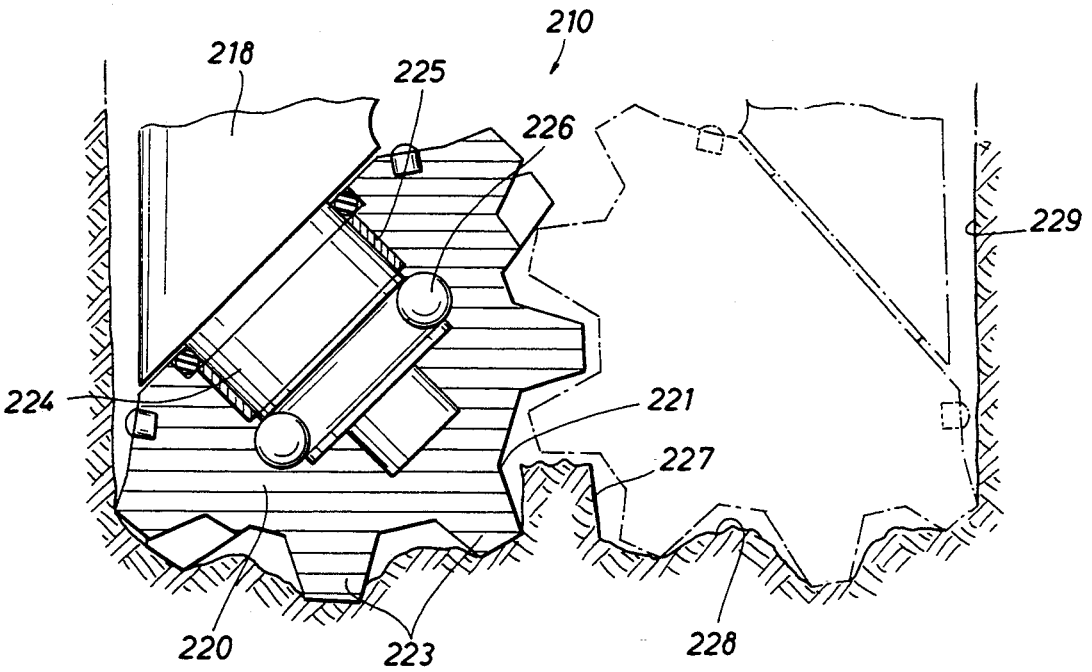
FIG. 6 is a partial cross-section of one milled tooth cone and a phantom outline of an adjacent cone depicting an uncut formation core.

FIG. 6 shows a bit 210 in a rotational position on the bottom 228 of borehole 229 cutting and leaving core 227. The example bit is designed to drill soft, non-abrasive rock formations. Bit 210 is fitted with milled steel teeth 223. The cone apex 221 is also fitted with a steel tooth 223 as the formations being drilled are very soft and non-abrasive. The steel apex tooth 223 will cut and maintain the diameter of core 227 because tooth 223 does not wear significantly to allow a grossly oversize core 227 to develop that would be difficult to break and flush away. Significant drilling rate increases are attained with normal bit 210 drilling life to effectively decrease the drilling cost per foot of hole drilled.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A rotary cone rock bit for drilling earthen formations, the rock bit being designed to form a core while drilling a borehole for enhanced bit penetration rates, said bit comprising:

a bit body having a first threaded pin end, a second cutter end and at least a pair of legs that support roller cutter cones rotatably retained on bearings cantilevered from an end of the legs, each of said cutter cones containing circumferential rows of individual cutters one or more core cutter means substantially at an apex of each cone for cutting adjacent to a central core; and wherein at least a portion of the cutters in circumferential rows extend a sufficient distance closer to a centerline of the rock bit than the core cutter means at the apex of a cone for breaking the central core.

2. The invention as set forth in claim 1 wherein each of said cutter cones contain circumferential rows of individual cutters and such a core cutter means substantially at an apex of a cone is a cutter that is harder than the cutters in the circumferential rows.

3. The invention as set forth in claim 1 wherein said one or more core cutter means is oblique to an axis formed by said cone.

4. The invention as set forth in claim 1 wherein said individual cutters in circumferential rows are tungsten carbide inserts, said one or more core cutter means formed substantially at an apex of each cone is a tungsten carbide insert including a layer of polycrystalline diamond on a portion of the insert extending beyond the surface of the cone.

5. The invention as set forth in claim 1 wherein each of said cutter cones contain circumferential rows of individual milled tooth cutters, said one or more core cutter means formed substantially at an apex of a cone is an insert type cutter.

6. A rotary cone rock bit for drilling earthen formations, the rock bit being designed to form a core while drilling a borehole for enhanced bit penetration rates, said bit comprising:

a bit body forming a first threaded pin end, a second cutter end and at least a pair of legs that support roller cutter cones rotatably retained on beatings cantilevered from an end of said legs, each of said cutter cones containing circumferential rows of individual cutters, the cutters on the cones being arranged for leaving a central core having a diameter in the range of 10 percent to 25 percent of the gage diameter of the bit; and one or more core cutter means being arranged substantially at an apex of each cone for cutting the core, the core cutter means comprising a material that is harder and more abrasion resistant than the individual cutters in each of the circumferential rows of cutters on the cutter cones.

7. The invention as set forth in claim 6 wherein said one or more core cutter means is oblique to an axis formed by said cone.

8. The invention as set forth in claim 6 wherein said individual cutters in circumferential rows are tungsten carbide inserts.

9. The invention as set forth in claim 6 wherein such a core cutter means comprises a tungsten carbide insert with a polycrystalline diamond surface layer.

10. A tungsten carbide insert rotary cone rock bit for drilling earthen formations, the rock bit being designed to form a core while drilling a borehole for enhanced bit penetration rates, said bit comprising:

a bit body having a first threaded pin end, a second cutter end and at least a pair of legs that support roller cutter cones rotatably retained on beatings cantilevered from an end of said legs, each of said cutter cones contain circumferential rows of individual cutters, the cutters on the cone being arranged for leaving a central core having a diameter in the range of 10 percent to 25 percent of the gage diameter of the bit; and one or more core cutter diamond coated inserts positioned substantially at an apex of each cone for cutting the core.

11. The invention as set forth in claim 10 wherein such a diamond coated core cutter insert is retained in the apex of a cone at an oblique angle relative to an axis of the cone.

12. A milled tooth rotary cone rock bit for drilling earthen formations, the rock bit being designed to form a core while drilling a borehole for enhanced bit penetration rates, said bit comprising:

a bit body having a first threaded pin end, a second cutter end and at least a pair of legs that support milled tooth roller cutter cones rotatably retained on bearings cantilevered from an end of said legs, each of the cutter cones containing circumferential rows of individual cutter teeth milled on the cone, the cutters on the cone being arranged for leaving a central core having a diameter in the range of 10 percent to 25 percent of the gage diameter of the bit; and one or more core cutter means substantially at an apex of each cone for cutting the core, the core cutter means comprising a material that is harder than the individual milled teeth in each of the circumferential rows formed on the cutter cones.

13. The invention as set forth in claim 12 wherein such a core cutter means is oblique to an axis formed by the cone.

14. The invention as set forth in claim 12 wherein the cutter cones are fabricated from steel, the individual cutter teeth in circumferential rows are milled from a body of the steel cone and each tooth comprises a surface layer of hardfacing.

15. The invention as set forth in claim 12 wherein such a core cutting means is a tungsten carbide insert.

16. The invention as set forth in claim 12 wherein such a core cutting means comprising a surface layer of polycrystalline diamond.

17. The invention as set forth in claim 1 wherein the distance between the core cutter means and the centerline of the bit leaves a core having a diameter in the range of 10 percent to 25 percent of the gage diameter of the bit.

18. The invention as set forth in claim 1 wherein at least a portion of the cutters in a circumferential row on one cone intermesh with cutters on an adjacent cone above the central core.

19. The invention as set forth in claim 6 wherein at least a portion of the cutters in circumferential rows extend a sufficient distance closer to a centerline of the rock bit than the core cutter means at the apex of a cone for breaking the central core.

20. The invention as set forth in claim 6 wherein at least a portion of the cutters in a circumferential row on one cone intermesh with cutters on an adjacent cone above the central core.

21. The invention as set forth in claim 12 wherein at least a portion of the cutters in circumferential rows extend a sufficient distance closer to a centerline of the rock bit than the core cutter means at the apex of a cone for breaking the central core.

22. The invention as set forth in claim 12 wherein at least a portion of the cutters in a circumferential row on one cone intermesh with cutters on an adjacent cone above the central core.

* * * * *